US006718579B1

(12) United States Patent
Greenstein

(10) Patent No.: US 6,718,579 B1
(45) Date of Patent: Apr. 13, 2004

(54) COVERING WITH FLIP PANELS

(75) Inventor: David Greenstein, New York, NY (US)

(73) Assignee: Homestead Fabrics, Ltd., New York, NY (US)

( * ) Notice: Subject to any disclaimer, the term of this patent is extended or adjusted under 35 U.S.C. 154(b) by 0 days.

(21) Appl. No.: 10/327,569

(22) Filed: Dec. 20, 2002

(51) Int. Cl.[7] ..... A47G 9/00
(52) U.S. Cl. ..... 5/502; 5/500; 5/482
(58) Field of Search ..... 5/482, 486, 500, 5/502

(56) References Cited

U.S. PATENT DOCUMENTS 4,353,193 A * 10/1982 Sanderson ..... 52/476
5,664,269 A * 9/1997 Broder ..... 5/486

* cited by examiner

*Primary Examiner*—Teri Pham Luu
*Assistant Examiner*—Fredrick Conley
(74) *Attorney, Agent, or Firm*—Ostrolenk, Faber, Gerb & Soffen, LLP

(57) ABSTRACT

A covering, for example, for a wall, a bed or a floor, has a base and at least one flip panel, wherein the flip panel is joined to the base along a flip axis. The flip panel allows a user to select between at least two different surface designs.

22 Claims, 9 Drawing Sheets

COVERING WITH FLIP PANELS

FIELD OF THE INVENTION

A covering with flip panels for use, for example, as a quilt, wall hanging or floor covering.

BACKGROUND OF THE INVENTION

Coverings with ornamental designs are used for a variety of purposes, including area rugs, bed coverings and wall coverings. An area rug provides the room with warmth and as an insulative surface to attenuate noise of traffic across hard flooring such as tiles, wood or linoleum. A bed covering or quilt is used for both its warmth and as a central focus for an interior design of a living room, bedroom, etc. Wall coverings are primarily used as an ornamental feature in interior design.

SUMMARY OF THE INVENTION

A covering with at least one flip panel comprises a base made of a suitable material, for example, a textile, and a flip panel joined to the base. The flip panel comprises a second material, which may be thinner than the first material. The flip panel is joined on one side to the base, along a line on the base that substantially divides the base into first and second symmetrical sections. Preferably, each section of the base displays a different visual effect or appearance.

The flip panel has a first surface and a second surface. The design on the first surface of the flip panel is different than the design on the second surface of the flip panel. The flip panel is joined to the base in such a manner that the flip panel may be flipped to expose the first section of the base with the first surface of the flip panel, while covering a second section of the base. Alternatively, the second section of the base with the second surface of the panel are exposed, while covering the second section of the base. Thus, a user may alter the appearance of the covering by turning the flip panel from one orientation to the other by flipping the panel about the flip axis.

In an alternative embodiment, a plurality of flip panels are joined to the base, allowing greater flexibility in the choice of the exposed design.

These aspects and advantages of the present invention, as well as others, will become apparent from the following description of the preferred embodiments which refer to the accompanying drawings.

BRIEF DESCRIPTION OF THE DRAWINGS

For the purpose of illustrating the invention, there is shown in the drawings a form which is presently preferred, it being understood, however, that the invention is not limited to the precise arrangements and instrumentalities shown.

DETAILED DESCRIPTION OF THE PREFERRED EMBODIMENTS

Figure 1:
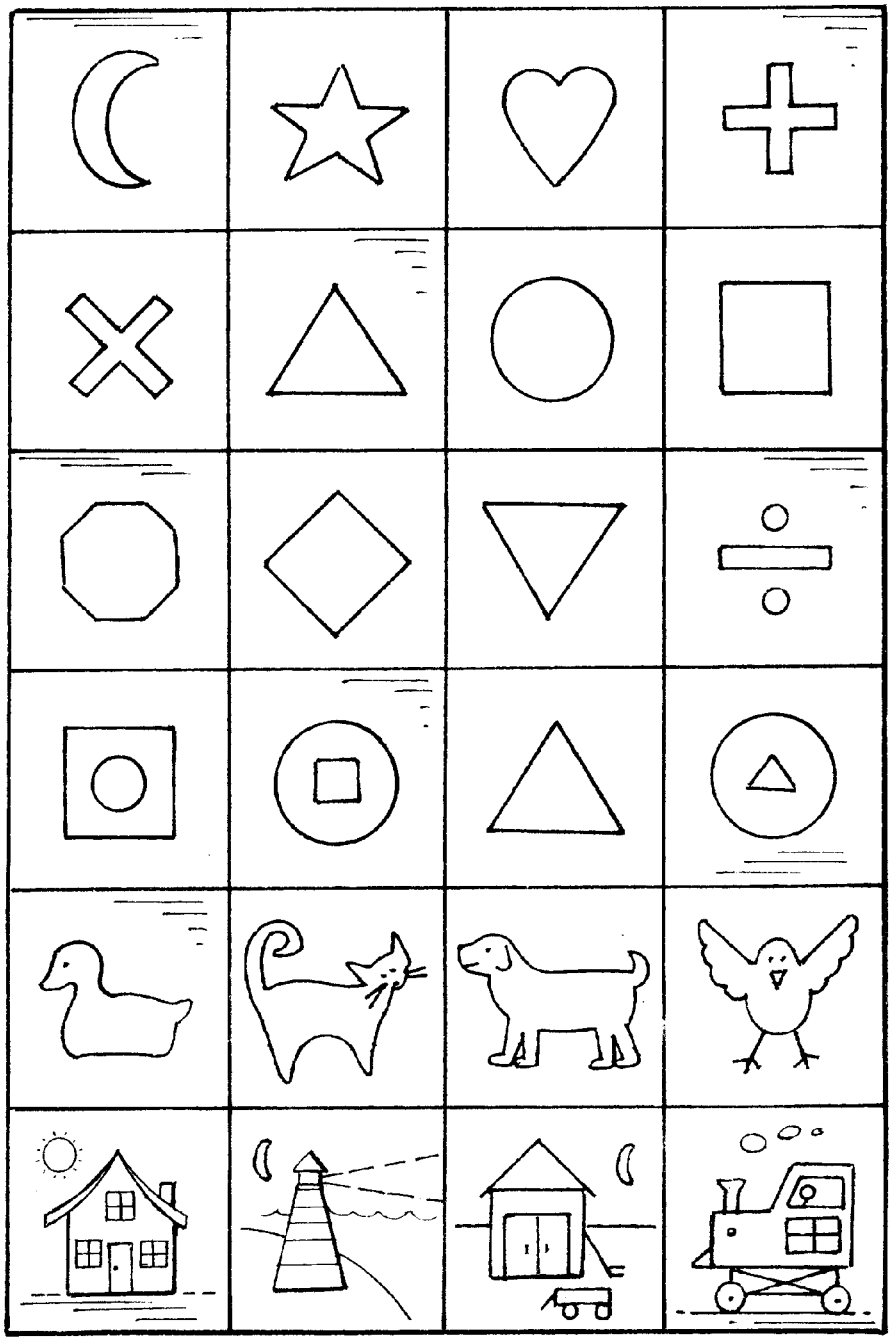
FIG. 1 PRIOR ART
FIG. 1 shows a quilt of the prior art.

FIG. 1 shows the prior art base with various designs that may appear thereon. The designs and their appearance are fixed. They cannot be altered.

Figure 2:
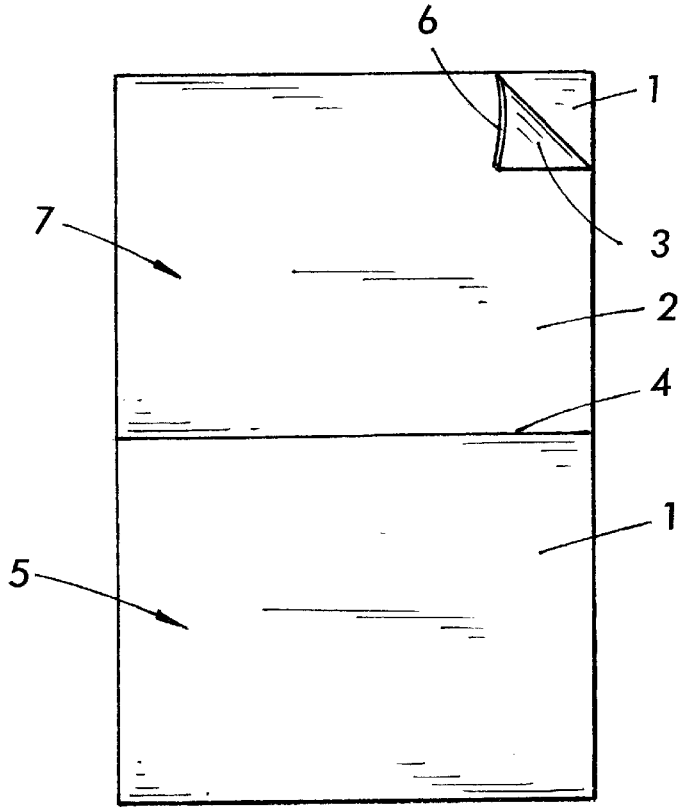
FIG. 2 shows one embodiment of the present invention.

FIG. 2 shows one embodiment of the present invention comprising a base 1 and a flip panel 7 having a top flip panel surface 2 and a bottom flip panel surface 3. The flip panel is attached to the base along a flip axis 4. FIG. 2 shows that the thickness of the base along the edge of the base 5 may be thicker than the thickness of the flip panel as shown by the thin edge 6 of the flip panel. The base 1 may be any conventional material, for example, a textile, a mat, a felt, a carpet material and combinations thereof. The flip panel or flip panels may be made of a material that matches the material of the base 1 or a different material from the material of the base 1, for example, a textile, a mat, a felt, a carpet and combinations thereof.

Figure 2A:
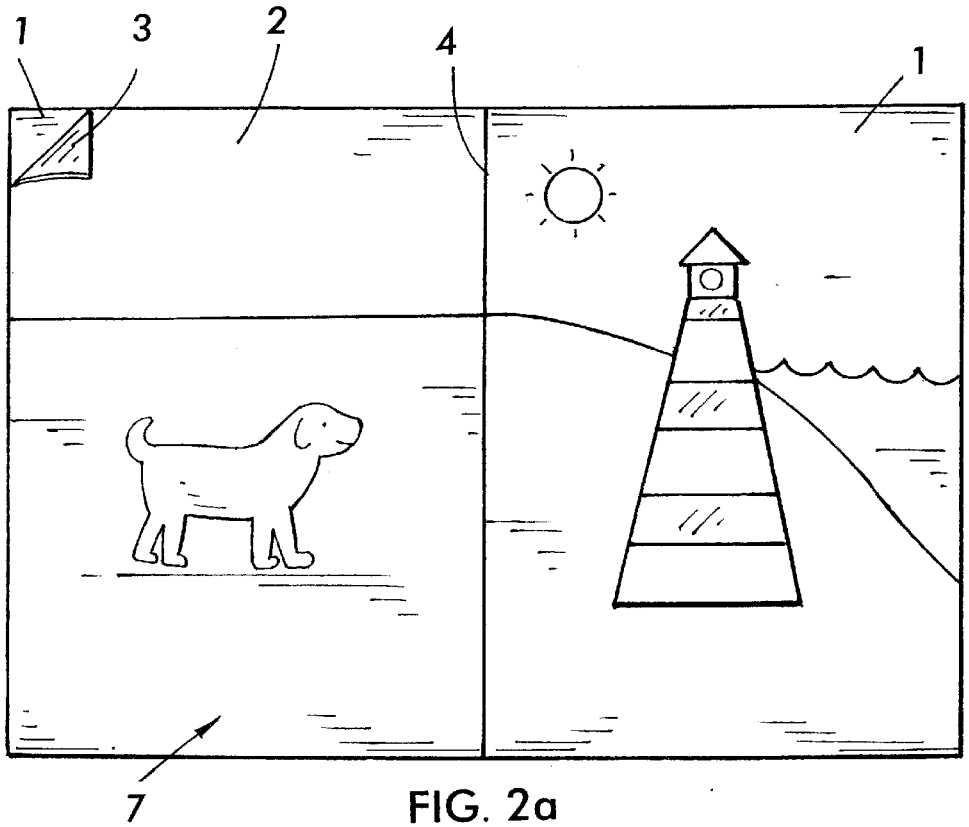
FIGS. 2*a* and 2*b* show surface ornamentations for one version of the embodiment of FIG. 2 of present invention.
Figure 2B:
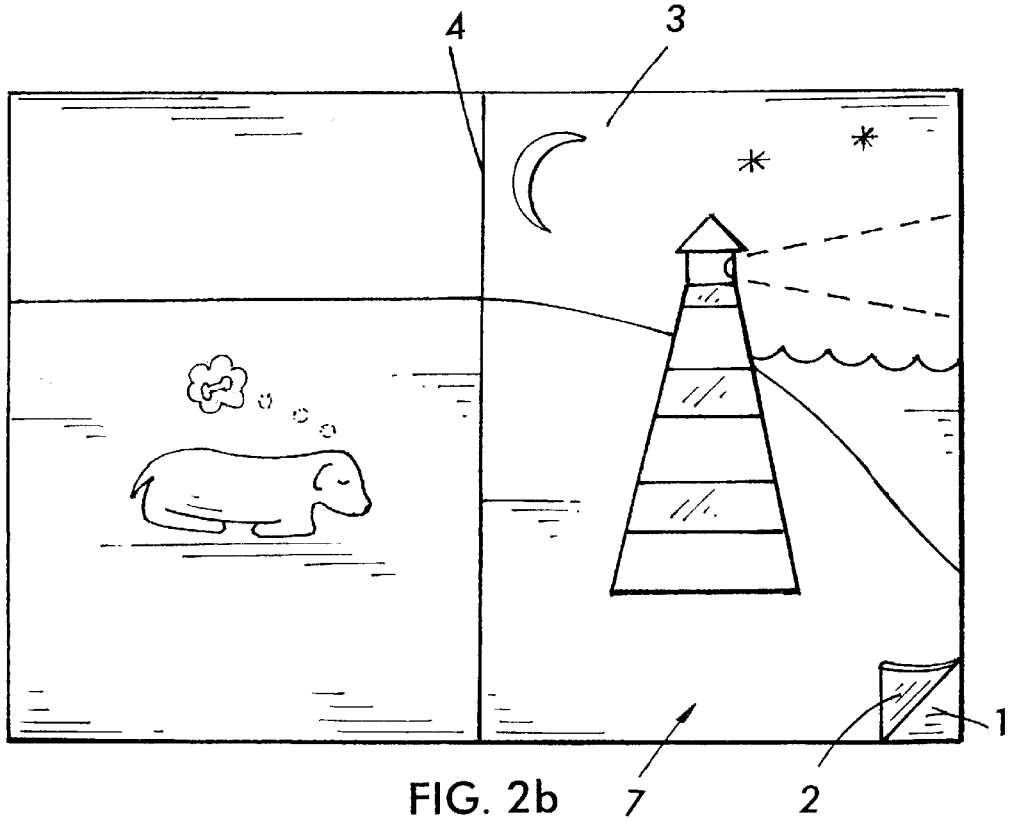

With reference to FIG. 2*a*, the covering of FIG. 2 can be provided with surface ornamentation, such that the surface design of the left section of the base is in the form of a cheerful and fully awake dog 201, facing the surface ornamentation 301 on the left hand side of the flip panel which is in the form of a lighthouse during the daytime with the sun shining. However, as shown in FIG. 2*b*, for nighttime purposes, the flip panel is now flipped, covering the daytime appearance of the covering and revealing the right hand side surface ornamentation 302 of the flip panel (in a form of a sleeping dog) with the lighthouse design 202, on the right hand side of the base, in a nighttime setting. Thus, with a simple flip of the flip panel 7, the mood or theme of the quilt is changed to suit a different timeframe or occasion.

Figure 3:
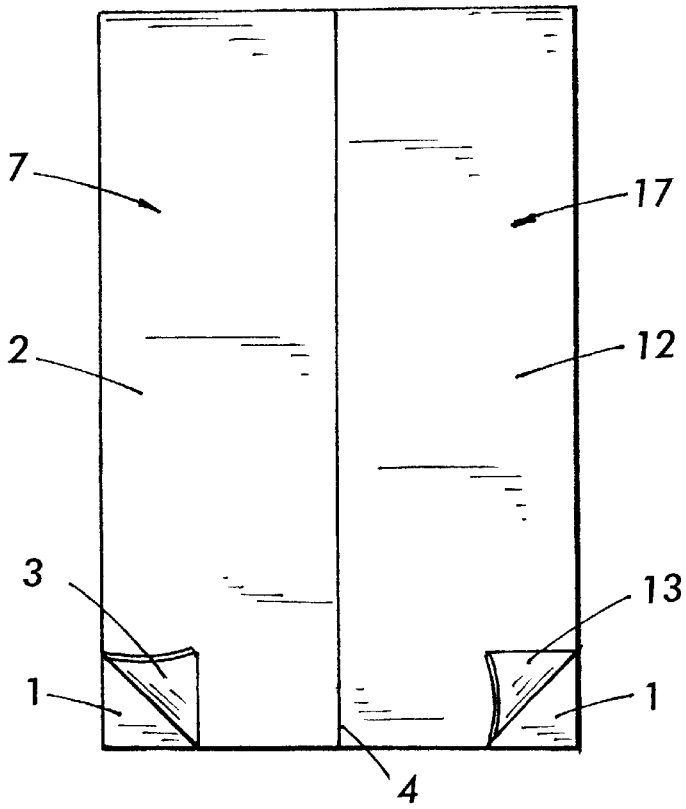
FIG. 3 shows another embodiment of the present invention.

FIG. 3 shows another embodiment of the present invention having two flip panels connected along a common axis 4 wherein each flip panel has a top surface 2 and 12 and a bottom surface 3 and 13. The common axis 4 attaches the two flip panels to the center of the base 1 along the longitudinal center line. In contrast, the flip panel in FIG. 2 is attached at a flip axis 4 located along the center line transverse to the longitudinal direction of the base.

Figure 4:
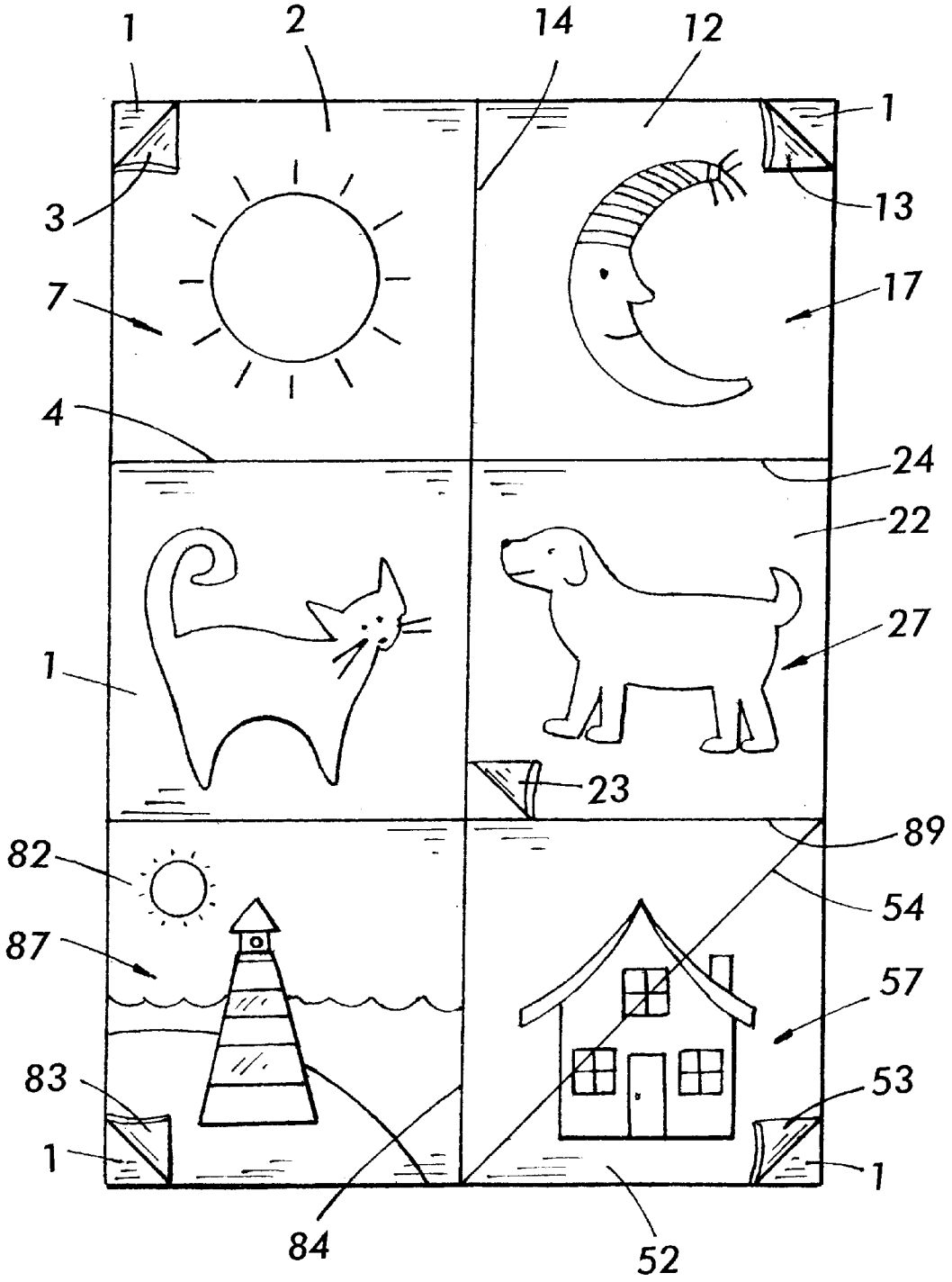
FIG. 4 shows a quilt with a plurality of flip panels.

FIG. 4 shows a covering, for example, a quilt, having a plurality of flip panels. Each of the flip panels has a top surface 2, 12, 22, 52, and 82. And a bottom surface 3, 13, 23, 53, and 83 opposite of the top surface, and a flip axis 4, 14, 24, 54, and 84. Each of the flip panels has a surface area that may cover at least a portion of the surface area of the base 1. For example, the flip panels may be the size of quilt blocks in a quilt and the base 1 may be a quilt block of a quilt. Each of the flip panels is attached to the base 1, for example, along one of the sides of the flip panels and/or at the flip axis. In alternative embodiments, the flip axis may be parallel to the longitudinal axis of the base 1, for example flip axis 14 and 84; parallel to the transverse axis of the base 1, for example flip axis 4 and 24; or diagonal from one corner of a flip panel to the other, for example flip axis 54. For example, a flip panel may be attached along two sides 84 and 89 and the flip axis 54 may run diagonally from the opposite corners of the two attached sides, or the flip panel 47, 67, 77 and 97, as shown in FIGS. 8*a*–8*d*, may be attached only along the diagonal flip axis 54 and 64.

An example of flip panels 7 and 17 with a flip axis 4 along a central horizontal axis of the base 1 is shown in FIG. 3. FIG. 2 shows a flip panel 7 having a flip axis 4 along a central transverse axis of the base 1. FIG. 4 shows a plurality of flip panels 7, 17, 27, 57 and 87 joined by a plurality of flip axises 4, 14, 24, 57 and 87. Each flip panel 7, 17, 27, 57 and 87 has a respective flip axis 4, 14, 24, 57 and 87 that may be alternatively common to more than one flip panel or different than the flip axis of one or more other flip panels.

Figure 5:
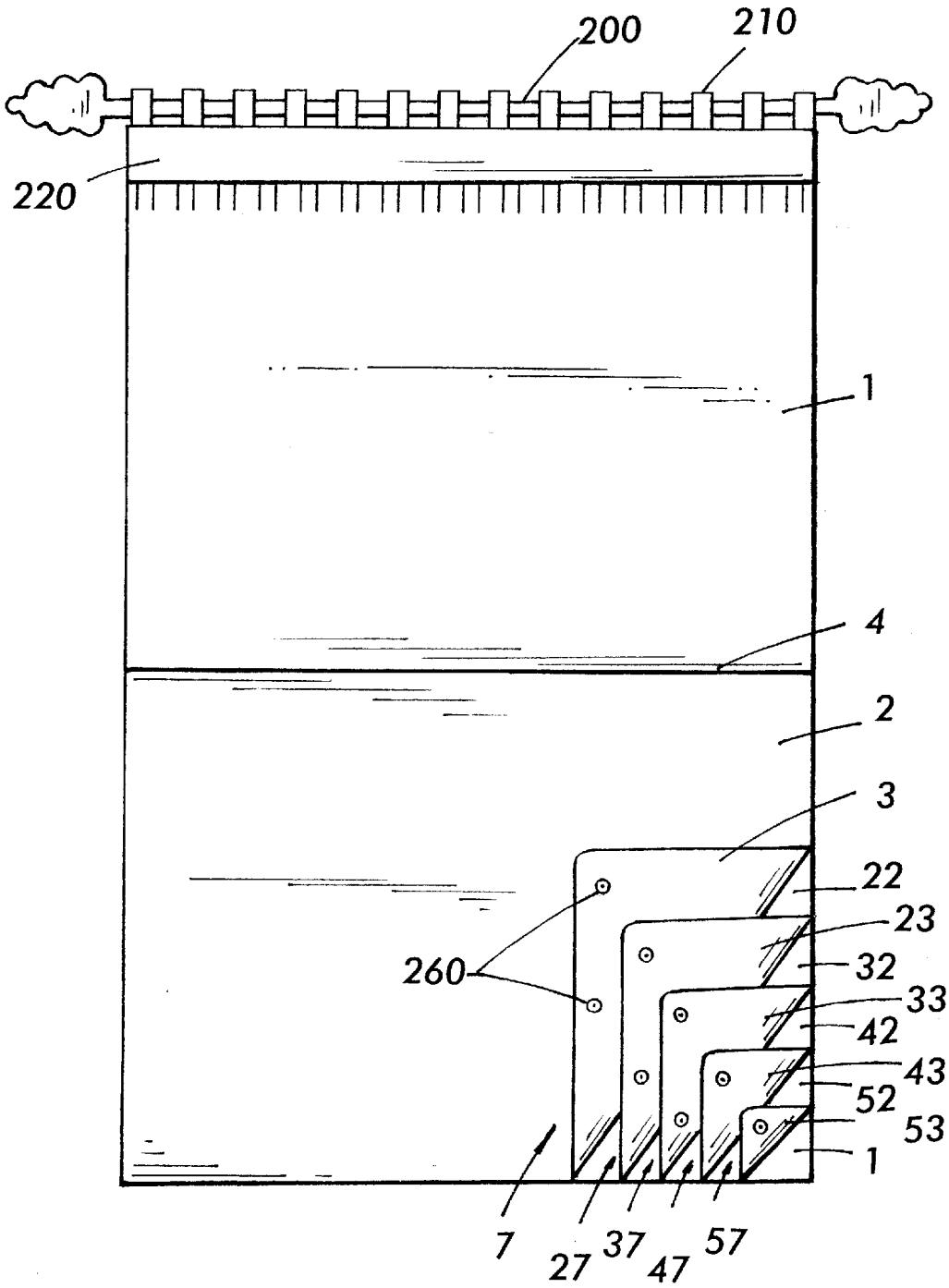
FIG. 5 shows a wall covering having a plurality of flip panels with a retaining mechanism.

FIG. 5 shows a,wall hanging having a mounting rod 200 and a mounting mechanism 210 which hangs the base 1 upon a vertical surface or opening. The wall hanging has a plurality of flip panels, each having a top surface 2, 12, 22, 32, 42 and 52 and a bottom surface 3, 13, 23, 33, 43 and 53 and each flip panel is attached to the base 1 along a common flip axis 4. The wall hanging has a retaining member 220, which retains the flip panels when the flip panels are positioned under the retaining member 220. Alternatively, the flip panels can be retained by the hanging mechanisms 210, by mechanical fasteners, such as rings, buttons, Velcro™, zippers, clips, and adhesives. In yet another embodiment, the flip panels adhere to the base 1 or to the bottom surface 3, 13, 23, 33 and 43 of the adjacent flip panel by electrostatic forces. The electrostatic forces may be generated using dissimilar materials with different electronegativities, for example, polyester and nylon. Alternatively, magnetic forces may be used by incorporating magnetic strips incorporated into the base and/or the flip panels.

In the embodiment shown in FIG. 5, the mechanical fastener is a plastic snap 260 which mates with a plastic snap (not shown) under the flap shown as 220. The flap 220 obscures the mechanical fasteners from normal viewing. Furthermore, the plastic snaps 260 which are attached to the flip panels, are not visible when the flip panels are flipped down. Therefore, the mechanical fasteners are not visible regardless if the flip panel is in the down or up position. By the down position, it is meant that the top surface 2, 12, 22, 32, 42 and 52 is showing, and by the up position, it is meant that the bottom surface 3, 13, 23, 33, 43 and 53 is showing. The fastener mechanism, whether mechanical, adhesive, or some other fastening mechanism, removably affixes the flip panels in the up position. The same fastening mechanism may be used to fix a flip panel in the down position. Alternatively, the force of gravity may be used to keep the flip panel in the down position.

Figure 6:
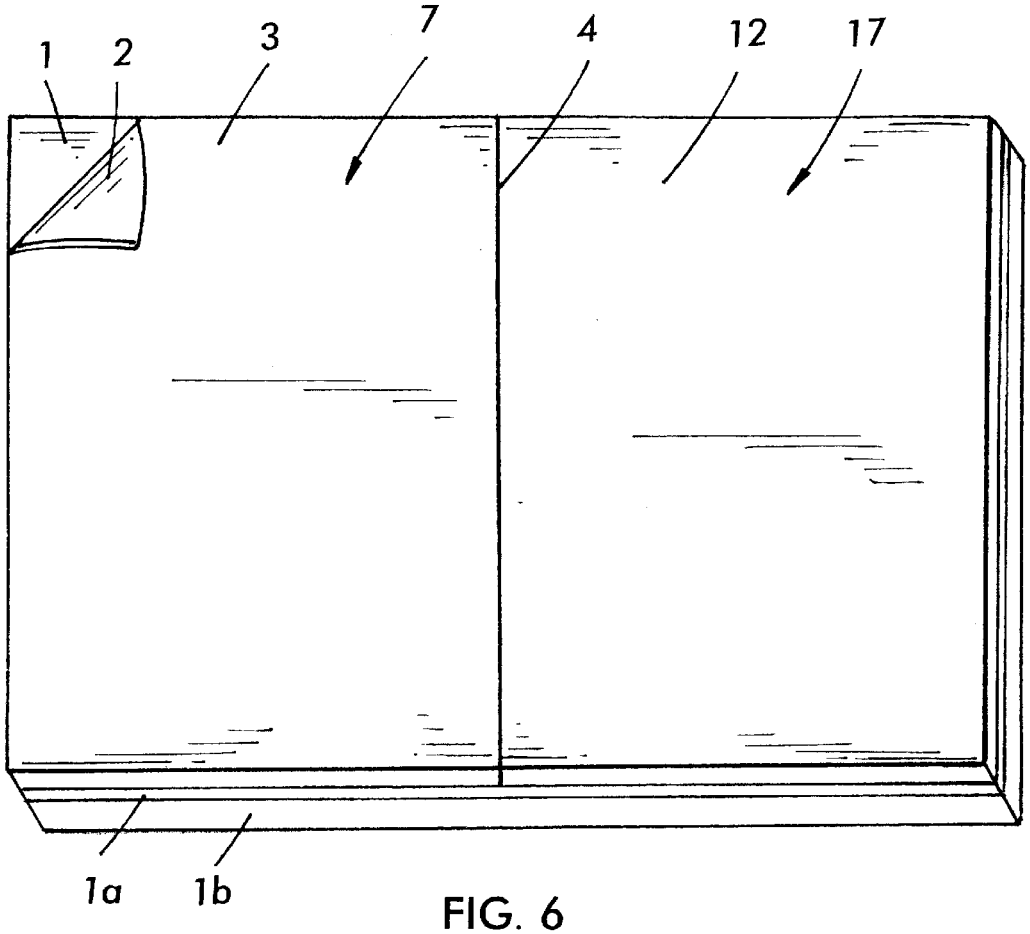
FIG. 6 shows an area rug having a plurality of flip panels joined along the same flipping axis.
Figure 7:
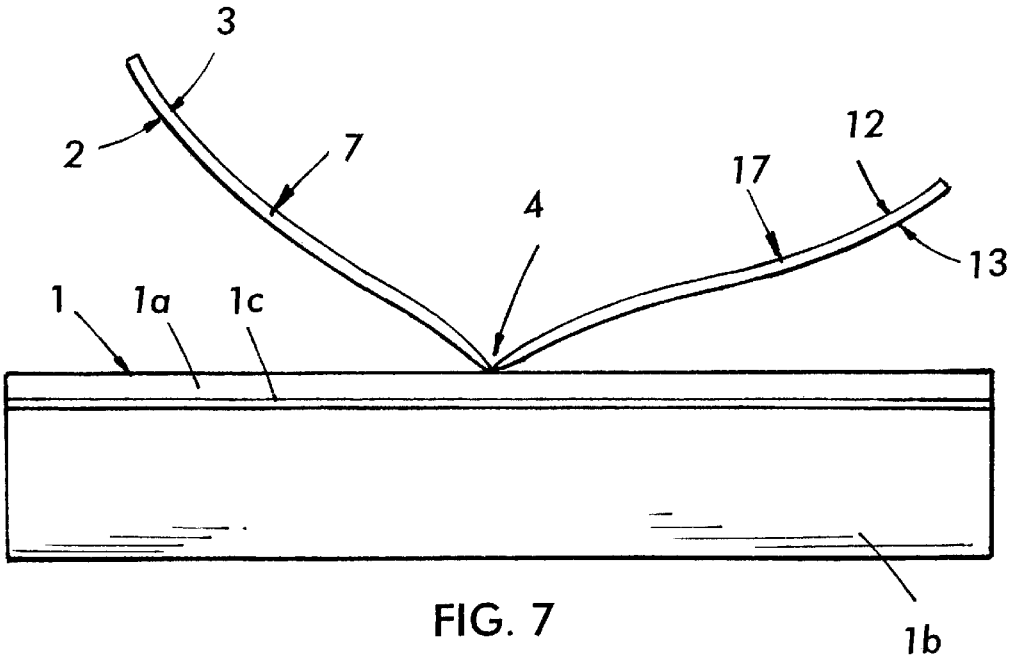
FIG. 7 shows a side view of the embodiment of FIG. 6.

FIG. 6 shows yet another embodiment of the present invention, a floor covering, such as an area rug, having a plurality of flip panels. In one specific embodiment, the base 1 is a composite material that has a textile 1 a fixedly attached to an elastomeric flexible material 1*b*. The flexible elastic material 1*b* is made, for example, from a rubber material or an elastomeric polymer. For example, the textile 1*a* may be affixed using an adhesive layer 1*c* on the flexible, elastic material 1*b*, as shown in FIG. 7.

Figure 8A:
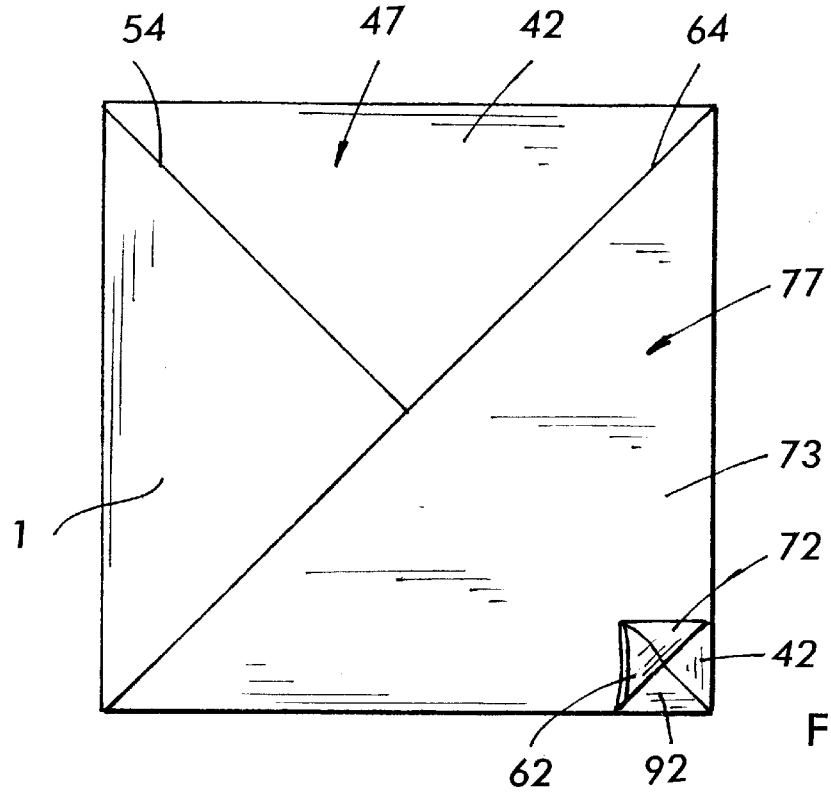
FIG. 8 shows an alternative embodiment of a covering with a flip panel.
Figure 8B:
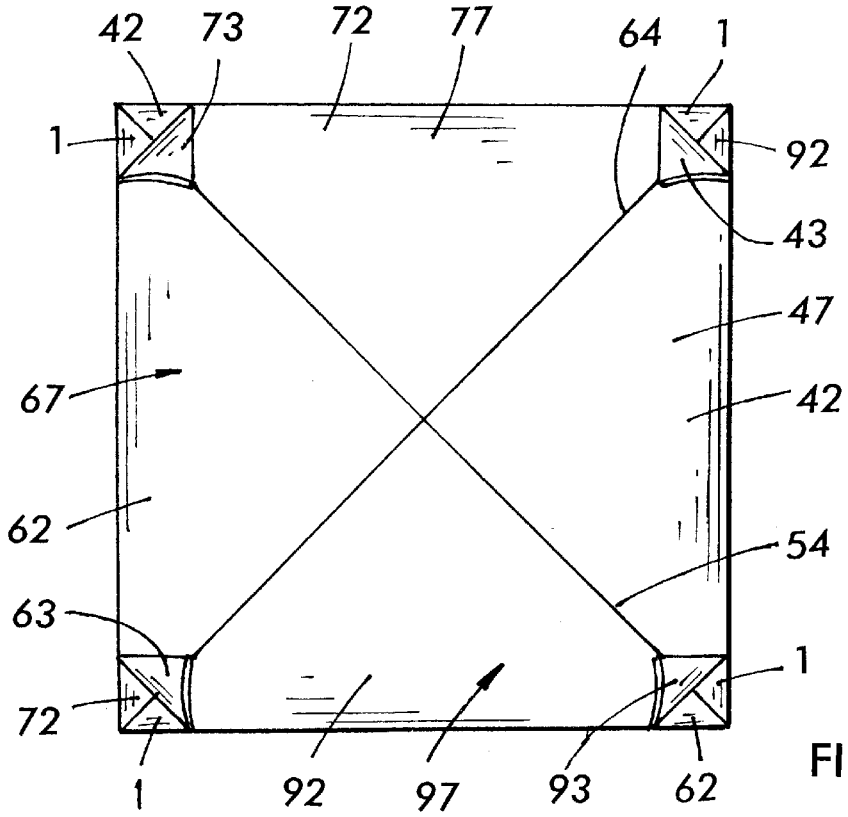
Figure 8C:
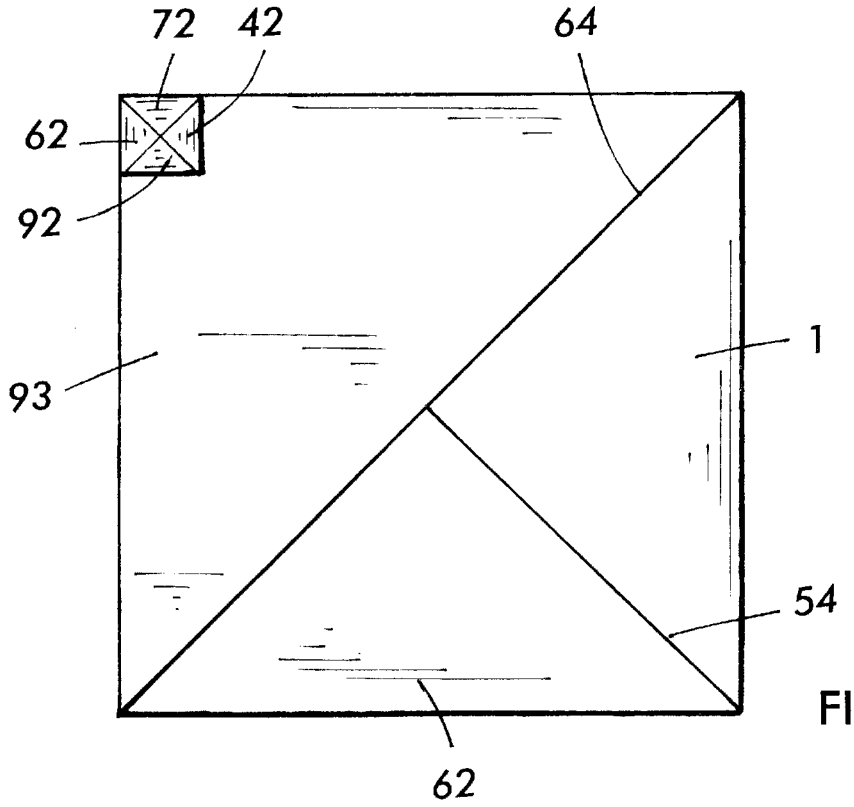
Figure 8D:
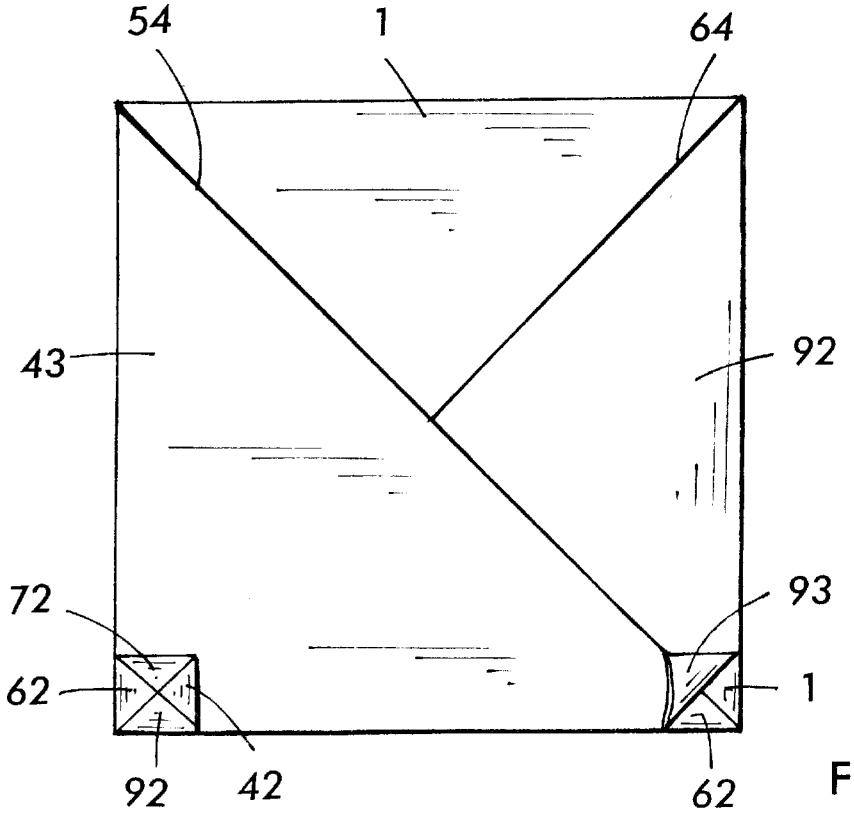

In FIGS. 8*a*–8*d* another embodiment of the invention is shown, which may display five different designs. A single square base 1 is attached to four triangular flip panels 47, 67, 77 and 97 either along a first diagonal axis 54 or a second diagonal axis 64. A first triangular panel 47 has top surface 42 and a bottom surface 43. A second triangular panel 77 has a top surface 72 and a bottom surface 73. A third triangular panel 67 has a top surface 62 and a bottom surface 63. A fourth triangular panel 97 has a top surface 92 and a bottom surface 93. The first panel 47 is attached along its hypotenuse to the base 1 along a portion of the first diagonal axis 54 and to a portion of the top surface 92 of the fourth panel 97. The second panel 77 is attached along its hypotenuse to the base 1 along a portion of the second diagonal axis 54 and to a portion of the top surface 42 of the first panel 47. The third panel 67 is attached along its hypotenuse to the base 1 along a portion of the first diagonal axis 54 and to a portion of the top surface 72 of the second panel 77. The fourth panel 97 is attached along its hypotenuse to the base 1 along a portion of the second diagonal axis 64 and to a portion of the top surface 62 of the third panel 67. FIGS. 8*a*–8*d* show 4 of the possible configurations. An upturned corner of the fifth configuration is shown in FIG. 8*b*, which exposes surfaces identified as 1, 72 and 63 of the base, the second panel 77, and the third panel 67, respectively.

Figure 9A:
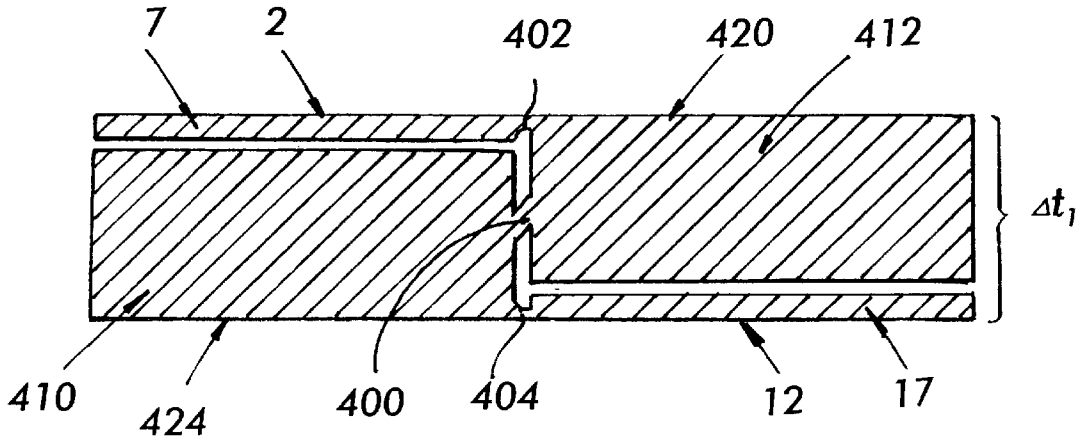
FIG. 9 shows a cross-sectional view of yet another alternative embodiment of a covering with a flip panel.
Figure 9B:
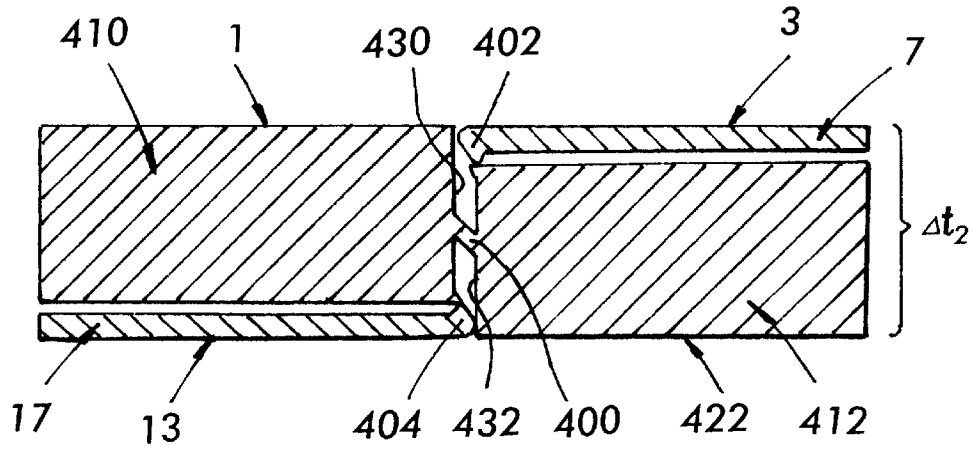

In yet another alternative design, a covering for a surface may comprise two bases 410 and 412, for example as shown in FIGS. 9*a* and 9*b*. Each base comprises a top surface 1 and 420 and an opposite bottom surface 424 and 422. The two bases 410 and 412 are joined by a living hinge 400 at an adjacent inner edge 430 and 432. The living hinge 400 allows the first base both to pivot and to translate relative to the second base. A first flip panel 7 has one design on one surface 2 and a different design on the opposite surface 3. The first flip panel 7 is joined at a flip axis to the second base 412 at the top surface 420 and along the inner edge 432 of the second base 412. The second flip panel 17 is joined at a different flip axis 404 to the first base 410 at the bottom surface 424 along the inner edge 430.

As shown in FIG. 9*a*, the covering will appear flat and uninterrupted at the flip axis 402 when the first panel 7 covers the first base 410 and the second panel 17 covers the second base 412, so long as the first panel 7 and the first base 410 have substantially the same thickness t1 as the second panel 17 and the second base 412. Also, if both the first panel 7 and the second panel 17 have substantially the same thickness, then the overall thickness of the covering will remain substantially the same (t1 t2) when the user flips both the first panel 7 and the second panel 17, as shown in FIG. 9*b*. The living hinge 400, which joins the first base 410 and the second base 412 along their respective inner edges 430 and 432, allows the first base 410 to translate in a direction upward relative to the second base 412 such that the surface of the covering shown in FIG. 9*b* still appears substantially flat (as shown by surfaces 1 and 3). A careful observer may be able to detect an interruption between the two surfaces 1 and 3 in this configuration. However, if the interruption is slight and/or located on a quilt boundary, for example, the overall impression of the observer will be of a substantially flat surface. Therefore, if the first panel 7 has a design on one surface 2 that thematically matches the corresponding design on the top surface 420 of the second base 412, then the user will perceive one coherent thematic design in the configuration shown in FIG. 9*a*. Also, if the first panel 7 has another design on its opposite surface 3 that thematically matches the corresponding design on the top surface 1 of the first base 410, then the user will perceive a different coherent thematic design in the configuration shown in FIG. 9*b*.

The two surfaces 12 and 13 of the second panel 17 may be blank, with the second panel acting merely as a filler to keep the top surfaces of the covering flat. Alternatively, the two surfaces 12 and 13 may likewise match the theme of the respective surfaces 422 and 424 of the two respective bases 412 and 410, which will allow the covering to be reversible, doubling the number of thematic designs that may be selected by the user.

In a specific embodiment of the present invention, the flip panel or panels allow the user to select two or more surface designs for the surface of the covering. For example, in FIG. 3, the top surface 2 of the first flip panel and the top surface 12 of the second flip panel produce a single coherent design. A second coherent design may be selected by flipping the first flip panel along the flip axis 4 such that the base 1 and the bottom surface of the first flip panel 3 produce a second coherent design. Alternatively, a third coherent design may be selected by flipping the second flip panel along the flip axis 4 revealing the bottom surface 13 of the second flip panel and the surface of the base 1, the two surfaces producing the third coherent design. In yet another: embodiment, FIG. 4 shows that a plurality of whimsical designs may be created by flipping one or more of the flip panels.

Although the present invention has been described in relation to particular embodiments thereof, many other variations and modifications and other uses will become apparent to those skilled in the art. It is intended, therefore, that the present invention be limited not by the specific disclosure herein, but only by the appended claims.

What is claimed is:

1. A covering for a surface, comprising:

a base having a top surface and a bottom surface opposite of the top surface; and plurality of flip panels, each flip panel having a first surface having a first design and a second surface opposite of the first surface having a second design and a flip axis, wherein the flip axis of each of the plurality of flip panels are joined to the top surface of the base and the first surface has a design that is different than the second surface, wherein each of the plurality of flip panels is capable of being positioned such that one of the first design or the second design is displayed and a portion of the top surface of the base is obscured.

2. The covering of claim 1, wherein the top surface of the base comprises a plurality of ornamental quilted designs having a width less than the width of the covering and a length less than the length of the covering.

3. The covering of claim 2, wherein each of the plurality of flip panels is positioned such that at least one of the plurality of ornamental quilted designs on the top surface of the base is obscured.

4. The covering of claim 3, wherein each of the plurality of flip panels is dimensionally smaller than the base such that only one of the plurality of ornamental quilted designs on the top surface of the base is obscured by each of the plurality of flip panels.

5. The covering of claim 4, wherein the plurality of ornamental quilted designs and the plurality of flip panels are capable of presenting at least four different appearances on the top surface of the covering and at least a first thematic appearance and a second, different thematic appearance by selectively positioning the plurality of flip panels in a first position and a second position, respectively.

6. The covering of claim 1, including a fastening mechanism that fastens at least one free edge of at least one of the plurality of flip panels to the base.

7. The covering of claim 6, wherein the fastening mechanism comprises one or more of a hook and loop mechanism, a zipper mechanism, an electrostatic mechanism and an adhesive mechanism.

8. A wall covering using the covering of claim 1, and further comprising mounting hardware for mounting the wall covering on a wall.

9. A quilt using the covering of claim 1, wherein the plurality of flip panels are size to obscure a single quilt block on the top surface of the base.

10. An area rug using the covering of claim 1, and further comprising a living hinge, wherein the surface of the area rug is not raised when complementary flip panels on each of the top surface and the bottom surface of the base are flipped.

11. A wall covering using the covering of claim 1, and further comprising and attachment mechanism, wherein the attachment mechanism adheres the wall covering to a wall.

12. The covering of claim 1, wherein at least one of the plurality of flip panels has a flip axis such that the flip axis divides at least a portion of the base into two parts.

13. The covering of claim 1, wherein the flip panel is made of a material selected from the group of materials consisting of a textile, a mat, a felt, a carpet and combinations thereof.

14. The covering of claim 13, wherein the base is made of a material selected from the group of materials consisting of a textile, a mat, a felt, a carpet and combinations thereof.

15. A wall covering comprising a base; a flip panel; and a flip axis, wherein the flip panel is joined to the base of the flip axis and the flip panel has a first surface having a first design and a second surface opposite of the first surface having a different design, and wherein the flip axis of the at least one of the plurality of flip panels comprises a diagonal line such that the diagonal line divides a portion of the base defined as a parallelogram into two triangular parts, and further comprising mounting hardware for mounting the wall covering on a wall, wherein the mounting hardware includes a rigid frame member on at least one edge of the base.

16. A covering for a surface, comprising a base; a flip panel; and a flip axis, wherein the flip panel is joined to the base at the flip axis and the flip panel has a first surface having a first design and a second surface opposite of the first surface having a different design, and wherein the flip axis of the at least one of the plurality of flip panels comprises a diagonal line such that the diagonal line divides a portion of the base defined as a parallelogram into two triangular parts.

17. A covering for a surface, comprising:

a base having a top surface and a bottom surface opposite of the top surface;

a plurality of flip panels, each of the plurality of flip panels including a first flip axis, a front surface and a back surface, and the front surface is the opposite side from the back surface, and each of the front surface and back surface has an ornamental design and each of the plurality of flip panels is fixedly attached to one of the bottom surface and the top surface of the base along at least a portion of the first flip axis.

18. The covering of claim 17, wherein the design on the front surface of each of the plurality of flip panels is different than the design on the back surface.

19. The covering of claim 17, wherein the position of the base of the first flip axis of one of the plurality of flip panels is different than position on the base of the first flip axis of another of the plurality of flip panels.

20. A covering for a surface, comprising:

a first base comprising a top surface, an opposite bottom surface and a edge between the top surface and the bottom surface of the first base;

a second base comprising a top surface, an opposite bottom surface and an edge between the top surface and the bottom surface of the second base;

a living hinge, wherein the living hinge joins an inner portion of the edge of the second base to an inner portion of the edge of the first base, and the living hinge allows the first base both to pivot and to translate relative to the second base; and a first flip panel having one design on a first surface and another design on a second surface;

a first flip axis, wherein the first flip axis joins the first flip panel to the top surface of the second base at the inner portion of the edge of the second base;

a second flip axis, wherein the second flip axis joins the second flip panel to the top surface of the second base at the inner portion of the edge of the first base.

21. The covering of claim 20, wherein the first flip panel and the second flip panel have a panel thickness that is substantially the same and the first base and the second base have a base thickness that is substantially the same.

22. The covering of claim 21, wherein the second flip panel has one design on a first surface and another design on a second surface.

* * * * *